US010244856B1

(12) United States Patent
Horsky

(10) Patent No.: US 10,244,856 B1
(45) Date of Patent: Apr. 2, 2019

(54) UNIVERSAL PHALANGI GRIP SYSTEM FOR TOOTHBRUSH AND UTENSILS

(71) Applicant: Casie Marie Horsky, West Palm Beach, FL (US)

(72) Inventor: Casie Marie Horsky, West Palm Beach, FL (US)

( * ) Notice: Subject to any disclaimer, the term of this patent is extended or adjusted under 35 U.S.C. 154(b) by 122 days.

(21) Appl. No.: 15/355,703

(22) Filed: Nov. 18, 2016

Related U.S. Application Data

(60) Provisional application No. 62/258,643, filed on Nov. 23, 2015.

(51) Int. Cl.

| | |
|---|---|
| ***A46B 5/02*** | (2006.01) |
| ***A46B 7/04*** | (2006.01) |
| ***B25G 1/10*** | (2006.01) |
| ***A47G 21/02*** | (2006.01) |
| ***A47G 21/04*** | (2006.01) |
| ***A45D 24/00*** | (2006.01) |
| ***A46B 5/00*** | (2006.01) |

(52) U.S. Cl.
CPC ..... *A46B 5/025* (2013.01); *A45D 24/00* (2013.01); *A46B 5/0095* (2013.01); *A46B 5/021* (2013.01); *A46B 7/04* (2013.01); *A47G 21/023* (2013.01); *A47G 21/04* (2013.01); *B25G 1/102* (2013.01); *A46B 2200/1066* (2013.01); *Y10T 16/476* (2015.01)

(58) Field of Classification Search
CPC ..... A46B 5/00; A46B 5/0095; A46B 5/02; A46B 5/021; A46B 5/023; A46B 5/025; A46B 5/026; A46B 7/04; A46B 7/042; A46B 7/044; A46B 7/046; A46B 7/048; A46B 15/0055; A46B 15/0059; Y10T 16/466; Y10T 16/476; B25G 1/102; A45D 24/00; A45D 24/02; A45D 24/04; A45D 24/06; A45D 24/10; A45D 24/14; A45D 24/16; A45D 24/18; A47G 21/02; A47G 21/023; A47G 21/026; A47G 21/04; A47G 21/045; A47J 43/28; A47J 43/281; A47J 43/282; A47J 43/288; B26B 1/10; B26B 3/00; B26B 3/02
USPC ..... 15/143.1, 145, 176.1–176.6; 16/421, 16/430; 30/322, 323, 324, 327; 132/148, 132/150; D4/104, 112, 129, 138
See application file for complete search history.

(56) References Cited

U.S. PATENT DOCUMENTS

| | | | | |
|---|---|---|---|---|
| 3,067,446 A * | 12/1962 | McGauley | ..... | A46B 5/02 15/143.1 |
| 3,753,266 A | 8/1973 | Ceniceros | | |
| 4,283,808 A * | 8/1981 | Beebe | ..... | A46B 5/02 15/145 |
| D324,455 S * | 3/1992 | Fasitta | ..... | D4/104 |
| 5,623,739 A | 4/1997 | Thompson | | |

(Continued)

FOREIGN PATENT DOCUMENTS

| | | | |
|---|---|---|---|
| JP | 2005-151882 | * | 6/2005 |
| WO | 93/10688 | * | 6/1993 |

*Primary Examiner* — Mark Spisich
(74) *Attorney, Agent, or Firm* — Harpman & Harpman

(57) ABSTRACT

An integrated enhanced grip and toothbrush consisting of an elongated contoured handle portion with an extending toothbrush in its preferred form. The handle has a plurality of finger engagement openings of flexible yieldable material in a linearly aligned spaced opposition providing for a no slip secure finger retainment for individuals with impaired or limited hand motor skills.

7 Claims, 2 Drawing Sheets

(56) References Cited

U.S. PATENT DOCUMENTS

| | | | | |
|---|---|---|---|---|
| D389,312 | S | 1/1998 | Porter | |
| 6,173,477 | B1 * | 1/2001 | Kikutani | A46B 5/02 15/143.1 |
| 6,546,583 | B1 | 4/2003 | Rohrig | |
| D490,983 | S | 6/2004 | Tini | |
| 8,931,855 | B1 * | 1/2015 | Foley | A46B 9/04 300/21 |
| 2008/0127459 | A1 * | 6/2008 | Burke | A63B 53/14 16/426 |
| 2014/0373862 | A1 * | 12/2014 | Prokop, III | A45D 24/14 132/150 |

* cited by examiner 10
16
19
11
13A
12

10
18
19
18
17
12
17
11
13
13A
2
2
14
F
10
18
18
16
12
11
13
15
13A
14

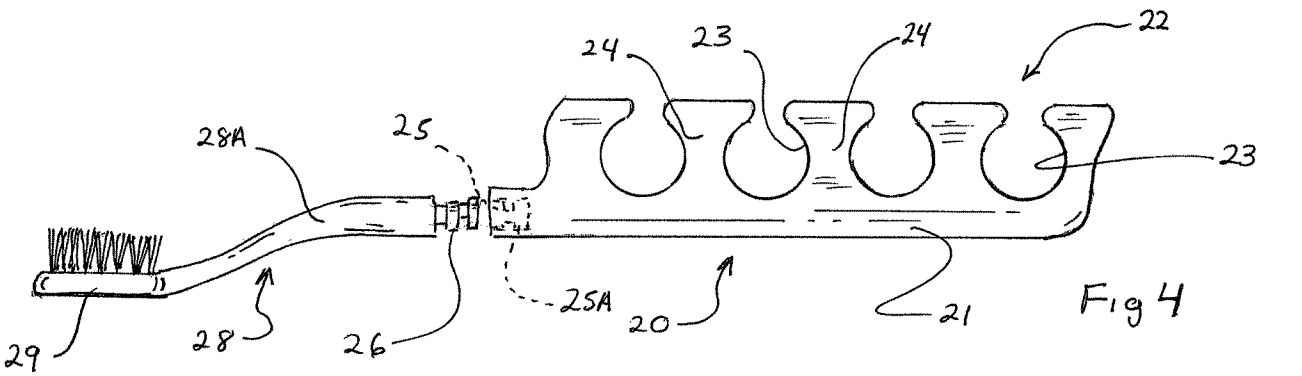
Fig 4
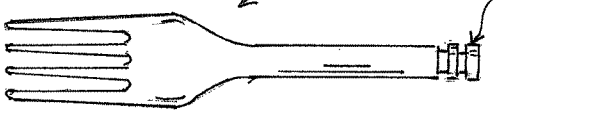
Fig 6
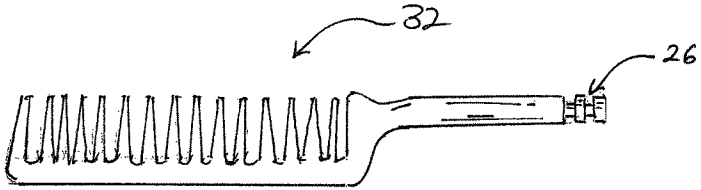
Fig 7
Fig 5

UNIVERSAL PHALANGI GRIP SYSTEM FOR TOOTHBRUSH AND UTENSILS

This application claims the benefit of U.S. Provisional Application Ser. No. 62/258,643, filed Nov. 23, 2015.

BACKGROUND OF THE INVENTION

1. Technical Field

This invention relates to hand grip aids for individuals having impaired or limited gripping ability due to age or physical impairment brought on by medical issues.

2. Description of Prior Art

Prior art devices have been directed to address the needs of individuals having limited physical abilities brought on by a variety of circumstances including age and medical related issues that restrict the individuals range of motion, grip and control applicable to handicap individuals. Such devices can be seen in U.S. Pat. No. 3,753,266, U.S. Pat. Nos. 5,623,739, 5,623,739, 6,546,583 and Design Pat. Nos. D389,312 and D490,983.

U.S. Pat. No. 3,753,266 illustrates an educational oral hygiene device for children having a circular toothbrush handle with angular cross members extending portion intersecting same.

U.S. Pat. No. 5,623,739 discloses a toddler/child toothbrush having a brush handle with a straight portion and a semi-circular curved extending portion from one side thereof to enhance and enable ease of grip.

U.S. Pat. No. 6,546,583 claims a toothbrush having a contoured curved elongated handle with a massaging end portion extending integrally therefrom.

U.S. Design Pat. No. D389,312 discloses an ornamental design toothbrush having an ovaloid open handle portion.

Finally, in U.S. Design Pat. No. D490,983 a toothbrush design is illustrated having an ergonomical grip with elongated brush heads.

SUMMARY OF THE INVENTION

A hand grip aid having a multiple open finger insertion engagement gripping elements of yieldable resilient foam material extending from an elongated implement supporting body member. A toothbrush extends therefrom in the primary form with the secondary embodiment illustrating multi-functional insertable implements in an alternate universal adapted form.

DESCRIPTION OF THE DRAWINGS

FIG. 1 is a side elevational view of the primary toothbrush finger grip handle and brush.

FIG. 4 is a side elevational exploded view of an alternate form of the invention illustrating a multiple interchangeable implement enabled extensions for the handle.

FIG. 5 is a side elevational view of a specific spoon attachment therein.

FIG. 6 is a side elevational view of a fork attachment therein.

FIG. 7 is a side elevational view of a grooming attachment comb therein.

DETAILED DESCRIPTION OF THE INVENTION

Figures 2, 3:
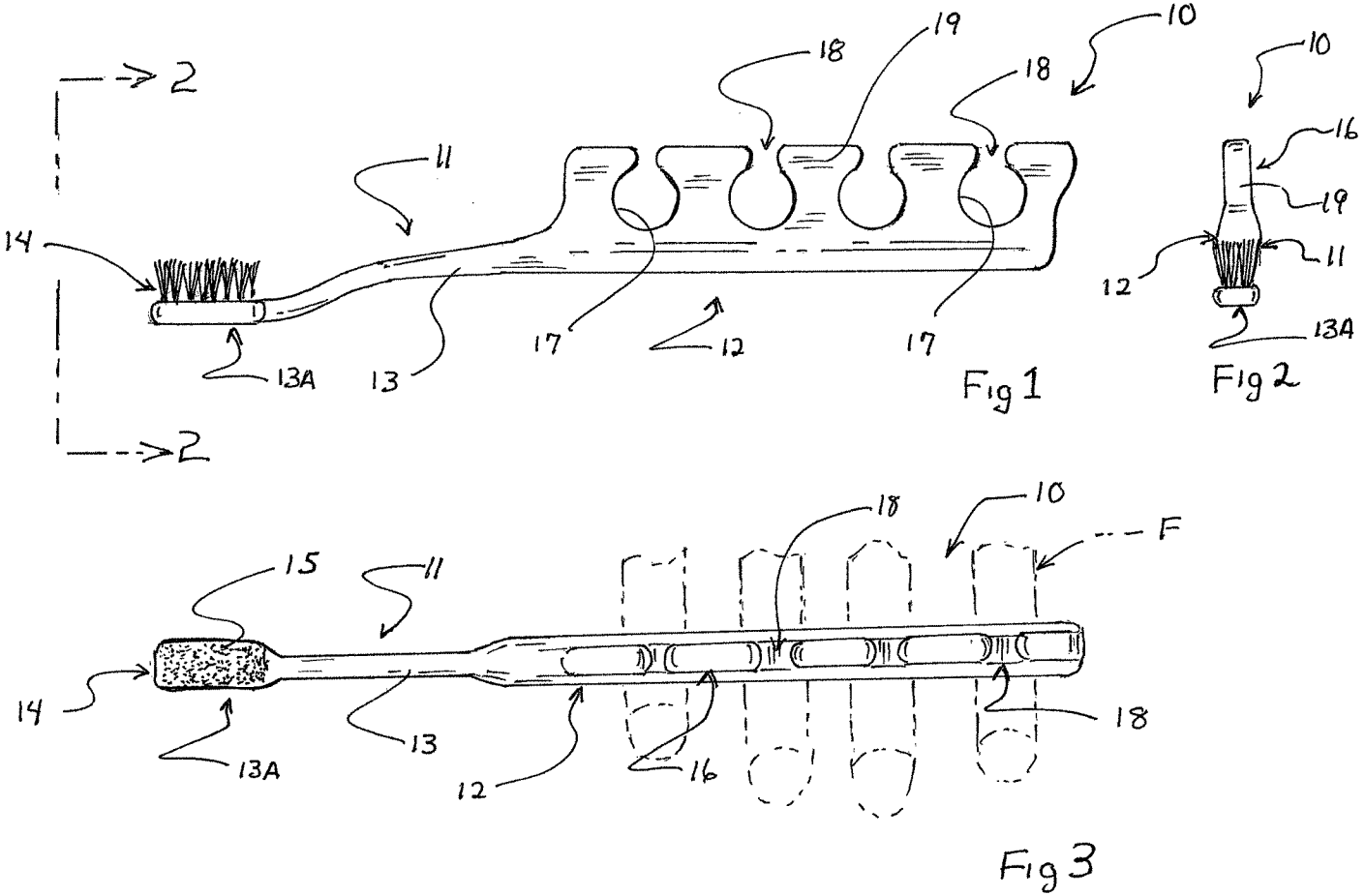
FIG. 2 is an end elevational view thereof on lines 2-2 of FIG. 1.
FIG. 3 is a top plan view thereof with finger representation shown in broken lines.

Referring to FIGS. 1-3 of the drawings, an improved hand grip 10 of the invention for a toothbrush 11 in this example can be seen. The hand grip 10 has an elongated rigid support base portion 12 from which an integral brush support 13 extends in longitudinal alignment therewith. A toothbrush head 14 is positioned on the end of the brush support 13 at 13A and has a plurality of standing brush bristles 15 in a co-mingled pattern that is well known and understood within the toothbrush art.

A segmented contoured finger engagement and retainment portion 16 of the hand grip 10 extends integrally from the base portion 12. The finger engagement portion 16 has a plurality of generally annular finger engagement openings at 17, each in longitudinal alignment with one another extending therefrom. The finger engagement openings 17 are formed from a flexible usable synthetic resin foam-like material and are of equal dimension, each having an upper opening at 18 therein. The placement of the respective openings at 18 in oppositely disposed relation to the base 12 define multiple intermediate connective web portions 19 between the respective finger engagement openings 17.

The web portions 19 are of an adjoining transverse dimension less than that of the respective finger engagement openings 17 so as to provide elastic retainment of the user's fingers F shown in broken lines once inserted there through thus eliminating the need to achieve a traditional grip about the handle of the toothbrush, in this example, which may be difficult given the user's physical limitations in this respect.

The frictional co-efficiency imparted by the improved hand grip 10 is such that holding is effortless and assures that the "toothbrush" will not slip or drop from the user's hand once the fingers have been inserted and retained as described above.

Referring now to FIGS. 4-7 of the drawings, an alternate form of the invention can be seen having a convertible interchangeable hand grip 20. The convertible interchangeable hand grip 20 has an elongated base 21 with a segmented contoured flexible finger engagement insertion portion 22 extending in upstanding relation therefrom. The finger engagement insertion portion 22 is identical to that of the hereinbefore described finger engagement portion 16 of the primary form of the invention and accordingly has multiple longitudinally aligned finger openings 23 therein with interconnecting webs 24 there between.

The base 21 has an interchangeable universal receiving fitting 25 therein with retainment elements 26 of a configured dimension to receive and retain a variety of interchangeable utensils. In this example, the receiving retainment fitting 25 has a resilient element 25A within adapted to engage and removably hold a correspondingly configured insert end retainment elements 26.

An example can be seen in a toothbrush insert 28 as illustrated in FIG. 4 of the drawings having a support arm 28A with a brush bristle head 29 thereon which can be selectively inserted within the receiving fitting 25 and retained in place.

Referring to FIGS. 5 and 6 of the drawings, a pair of alternate interchangeable utensils can be seen, in this case configured as a fork 30 in FIG. 6 and a spoon 31 in FIG. 5 of the drawings. It will therefore be apparent that a variety of such configured utensils may be interchangeably inserted into the universal receiving convertible hand grip 20 allowing a handicapped user the ability to use a variety of different utensils with a single universal convertible hand grip 20.

An example of such variety of such use applications is seen for illustration purposes in FIG. 7 of the drawings wherein a comb configuration 32 is illustrated and can be selectively engaged and retained in the convertible hand grip 20 therefore expanding the usefulness and capabilities for the user as is set forth in the above referred to description.

It will thus be seen that a new and novel improved hand grip for handicapped individuals has been illustrated and described and that by combining elongated supported base portion with a segmented contoured finger engagement and retainment portion 16 and 22 of yieldable flexible material will allow a user to effectively insert his or her fingers F into the respective finger engagement openings 17 and 23 which adapt due to their flexibility and allow the hand grip to be self-supporting without requirement of gripping by the user.

It will be apparent to those skilled in the art that various changes and modifications may be made therein without departing from the spirit of the invention.

Therefore, I claim:

1. A toothbrush for individuals with impaired hand gripping ability comprises, a handle portion and a brush portion, said handle portion of unitary construction having an elongated rigid support base, an integral upstanding flexible segmented finger engagement portion with multiple longitudinally spaced finger engagement openings therein, each of the finger engagement openings having an associated upper opening with a dimension along the length of the handle that is less than the respective figure engagement opening, intermediate connective web portions between said respective finger engagement openings, upper ends of adjacent web portions defining each respective upper opening, said brush portion having an elongated support extending longitudinally from said support base, a brush head having a co-mingled bristle pattern extending therefrom.

2. The toothbrush for individuals with impaired hand gripping ability set forth in claim 1 wherein said connective web portions are of a known dimension less than the known dimension of said finger engagement openings and are in longitudinally spaced relation to one another forming said finger openings there between.

3. The toothbrush for individuals with impaired hand gripping ability set forth in claim 1 wherein said web portions are of an adjoining transverse dimension less than that of said respective finger engagement openings there between.

4. The toothbrush for individuals with impaired hand gripping ability set forth in claim 1 wherein said brush portion comprises, an elongated rigid brush support extending from the longitudinal axis of said handle portion, a toothbrush head on the free end of said brush support.

5. The toothbrush for individuals with impaired hand gripping ability set forth in claim 1 wherein said elongated rigid support base is of an increased transverse dimension.

6. The toothbrush set forth in claim 1 wherein said handle portion and said brush portion are made of synthetic resin material.

7. A toothbrush system for individuals with impaired hand gripping ability comprises in combination, a handle portion and an interconnected bristle support portion, said handle portion of unitary construction having an elongated rigid support base, an integral upstanding flexible segmented finger engagement portion with multiple longitudinally spaced finger engagement openings therein, each of the finger engagement openings having an associated upper opening with a dimension along the length of the handle that is less that the respective figure engagement opening, intermediate connective web portions between said respective finger engagement openings, upper ends of adjacent web portions defining each respective upper opening, said handle portion having a universal end receiving fitting for receiving a variety of interchangeable attachments there within, said interchangeable attachments comprising said bristle support portion, eating utensils and a comb.

* * * * *